US009945541B1

(12) United States Patent
Kuo

(10) Patent No.: US 9,945,541 B1
(45) Date of Patent: Apr. 17, 2018

(54) LIGHT-EMITTING DIODE MODULE HOLDER

(71) Applicant: KEEPER TECHNOLOGY CO., LTD., New Taipei (TW)

(72) Inventor: Chung-Hsien Kuo, New Taipei (TW)

(73) Assignee: KEEPER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/384,901

(22) Filed: Dec. 20, 2016

(51) Int. Cl.

| | |
|---|---|
| ***F21V 19/00*** | (2006.01) |
| ***F21V 23/06*** | (2006.01) |
| ***F21S 8/10*** | (2006.01) |
| ***F21V 17/12*** | (2006.01) |
| ***F21V 17/00*** | (2006.01) |
| *F21Y 115/10* | (2016.01) |

(52) U.S. Cl.
CPC ..... *F21V 19/0015* (2013.01); *F21S 48/34* (2013.01); *F21V 17/005* (2013.01); *F21V 17/12* (2013.01); *F21V 23/06* (2013.01); *F21Y 2115/10* (2016.08)

(58) Field of Classification Search
CPC .... F21V 19/0015; F21V 17/005; F21V 17/12; F21V 23/06; F21V 19/003; F21S 48/34; F21Y 2115/10
USPC ..... 362/382, 249.02, 646, 640, 657, 658, 362/659, 652, 647; 439/76.1
See application file for complete search history.

(56) References Cited

U.S. PATENT DOCUMENTS

| | | | |
|---|---|---|---|
| 7,290,913 | B2 | 11/2007 | Watanabe et al. |
| 7,750,458 | B2 | 7/2010 | Takeda et al. |
| 7,901,123 | B2 | 3/2011 | Takeda et al. |
| 8,016,469 | B2 | 9/2011 | Takeda et al. |
| 8,328,401 | B2 | 12/2012 | Matsunaga |
| 8,523,416 | B2 | 9/2013 | Ohmi et al. |

(Continued)

FOREIGN PATENT DOCUMENTS

| | | |
|---|---|---|
| CN | 202266955 | 6/2012 |
| JP | 5351065 | * 11/2013 |

(Continued)

OTHER PUBLICATIONS

Taiwanese Office Action for TW105132013, dated Apr. 19, 2017, Total of 8 pages.

(Continued)

*Primary Examiner* — Laura Tso
(74) *Attorney, Agent, or Firm* — Lynette Wylie; Apex Juris, pllc.

(57) ABSTRACT

A light-emitting diode (LED) module holder includes a base, a connection portion and two terminals. The base has an accommodation space formed through the base and two rear rests formed inside the accommodation space. The connection portion is formed on a rear portion of the base and has a socket formed in a rear of the connection portion. The two terminals are securely mounted in the socket. Each terminal has an insertion segment mounted inside the socket of the connection portion, an electrical contact segment formed on a front end of the insertion segment and extending forwards into the accommodation space, and a limiting piece formed on the terminal and located above a corresponding rear rest. The LED module is mounted into the accommodation space and is held between the rear rests and the limiting pieces to avoid escaping from the base.

14 Claims, 9 Drawing Sheets

(56) References Cited

U.S. PATENT DOCUMENTS

| | | | | |
|---|---|---|---|---|
| 8,602,619 | B2 | 12/2013 | Matsunaga | |
| 8,801,251 | B2 | 8/2014 | Ohmi et al. | |
| 9,035,346 | B2 | 5/2015 | Matsunaga et al. | |
| 2014/0160773 | A1* | 6/2014 | Peters | F21S 48/1109 362/382 |

FOREIGN PATENT DOCUMENTS

| | | |
|---|---|---|
| TW | M460990 | 9/2013 |
| TW | M514537 | 12/2015 |

OTHER PUBLICATIONS

English Abstracts for CN202266955, TWM460990, and TWM514537, Total of 2 pages.

* cited by examiner

LIGHT-EMITTING DIODE MODULE HOLDER

BACKGROUND OF THE INVENTION

1. Field of the Invention

The present invention relates to a light-emitting diode (LED) module holder and, more particularly, to an LED module holder facilitating fast mounting of an LED module in a headlight of a vehicle.

2. Description of the Related Art

With reference to FIG. 9, a conventional LED module 90 is mounted inside a vehicular headlight through a fixing member 80. The fixing member 80 includes a base 81 and a connector 83. The base 81 has an opening 810, multiple stoppers 84 and two electrical contacts 85. The opening 810 is formed through the base 81. The multiple stoppers 84 are formed on and protrude inwards from an inner wall of the opening 810. The two electrical contacts 85 are also formed on and protrude inwards from an inner wall of the opening 810. The connector 83 is formed on one side of the fixing member 80 and has two terminals 86 mounted therein and electrically connected to the respective electrical contacts 85. The LED module 90 is mounted within the opening 810 of the base 81 and has a ceramic substrate 91, an LED die 93 and two electrodes 95. The LED die 93 is mounted on the ceramic substrate 91. The two electrodes 95 are mounted on the ceramic substrate 91 to electrically connect to the LED die 93 and abut against the respective electrical contacts 85 of the base 81. The LED die 93 is held by the multiple stoppers 84 to prevent the LED module 90 from escaping from the opening 810.

However, the fixing member 80 alone fails to securely fasten the LED module 90. Instead, the fixing member 80 should be collaborated with other fixing members inside the headlight to make the LED module securely held between the fixing member 80 and the other fixing members. The difficulty in mounting the LED module 90 thus increases.

SUMMARY OF THE INVENTION

An objective of the present invention is to provide a light-emitting diode (LED) module holder facilitating fast mounting of an LED module therein and allowing the LED module to be mounted in a vehicular lamp.

To achieve the foregoing objective, the LED module holder includes a body, two terminals and an LED module.

The body has a base and a connection portion.

The base has an accommodation space, a front opening, two rear rests and two reverse-barb arms.

The accommodation space is formed through the base.

The front opening is formed through a front portion of the base.

Each rear rest is formed on and protrudes inwards from a rear portion of one of two lateral inner walls of the accommodation space.

The two reverse-barb arms are respectively formed on and protrude inwards from the two lateral inner walls and are located above the rear rests.

The connection portion is formed on and protrudes rearwards from a rear portion of the base and has a socket formed in a rear of the connection portion.

The two terminals are securely mounted in the connection portion. Each terminal has an insertion segment, an electrical contact segment and a limiting piece.

The insertion segment is securely mounted inside the socket of the connection portion and extends rearwards.

The electrical contact segment is formed on a front end of the insertion segment and extends forwards into the accommodation space of the base.

The limiting piece is formed on the terminal and is located above a corresponding rear rest.

The LED module is mounted into the accommodation space of the base through the front opening of the base and has a substrate, an LED die and two electrodes.

The substrate is mounted inside the accommodation space, is held between the limiting pieces of the terminals and the rear rests, and is held by the two reverse-barb arms to prevent the substrate from escaping from the accommodation space through the front opening.

The LED die is mounted on the substrate.

The two electrodes are mounted on the substrate to electrically contact the respective electrical contact segments of the terminals.

Given the foregoing LED module holder, after entering the accommodation space of the base, the substrate is held between the rear rests of the base and the limiting pieces of the two terminals, such that the LED module is securely mounted inside the base. Upon mounting the LED module holder to a lamp, all it needs is to focus on inserting the connection portion into the lamp without worrying about inadvertent drop of the LED module. Besides, the reverse-barb arms further hold the LED module to prevent the LED module from escaping from the base through the front opening.

Other objectives, advantages and novel features of the invention will become more apparent from the following detailed description when taken in conjunction with the accompanying drawings.

DETAILED DESCRIPTION OF THE INVENTION

Figure 1:
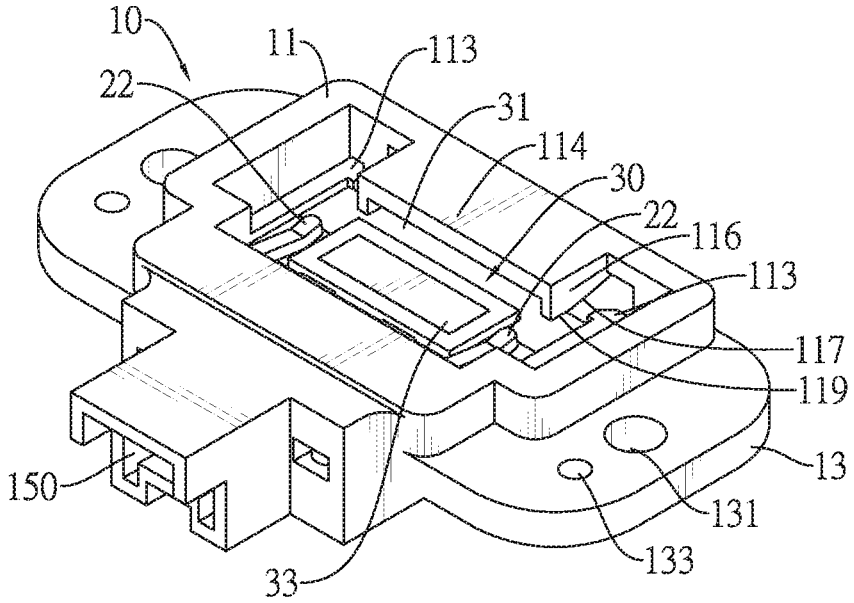
FIG. 1 is a first perspective view a first embodiment of an LED module holder in accordance with the present invention.
Figure 2:
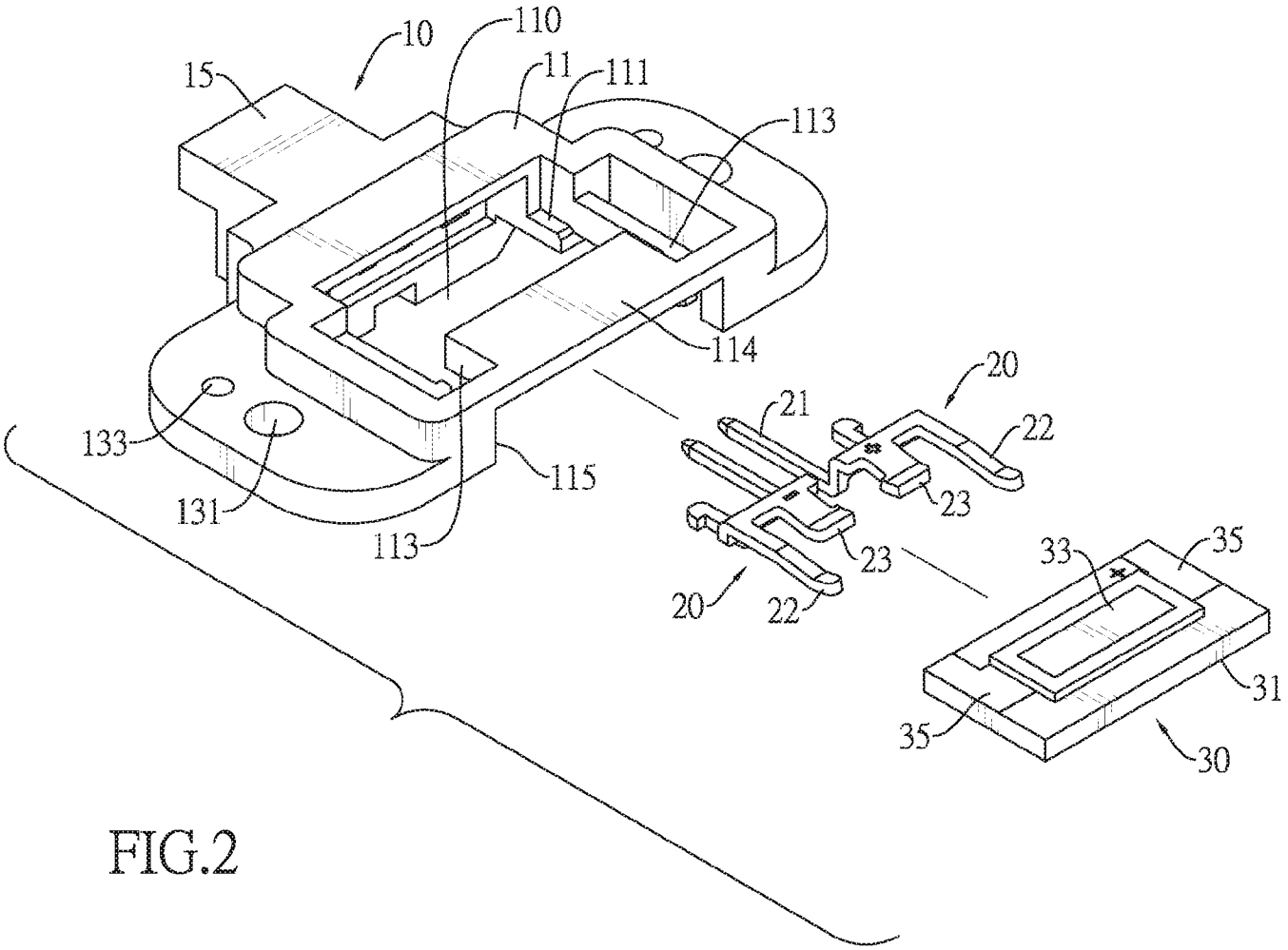
FIG. 2 is an exploded perspective view of the LED module holder in FIG. 1.
Figure 3:
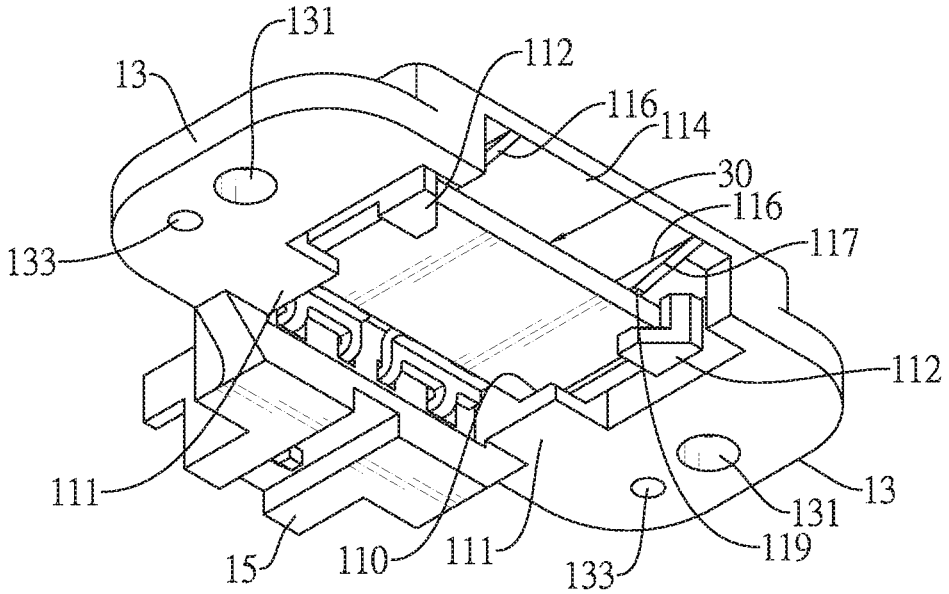
FIG. 3 is a second perspective view of the LED module holder in FIG. 1.

With reference to FIGS. 1, 2 and 3, a first embodiment of a light-emitting diode (LED) module holder in accordance with the present invention includes a body 10, two terminals 20 and an LED module 30.

The body 10 has a base 11, a connection portion 15 and two wing portions 13. The base 11 has an accommodation space 110, a front opening 115, two rear rests 111, two front rests 112, two reverse-barb arms 113 and an extension 114. The accommodation space 110 is formed through the base 11. The front opening 115 is formed through a front portion of the base 11 and communicates with the accommodation space 110. Each rear rest 111 is formed on and protrudes inwards from a rear portion of one of two lateral inner walls of the accommodation space 110. Each front rest 111 is formed on and protrudes inwards from a front portion of one of the two lateral inner walls of the accommodation space 110 and is adjacent to the front opening 115. The two reverse-barb arms 113 are respectively formed on and protrude inwards from the two lateral inner walls with a barbed end on each of the reverse-barb arms 113 and are located above the rear rests 111 and the front rests 112. The extension 114 is formed on and protrudes rearwards from an upper portion of a front inner wall of the accommodation space 110 and has two guiding portions 116 formed on a bottom of the extension 114. Each guiding portion 116 has a bevel surface 117 and a flat surface 119. The bevel surface 117 is formed on and extends rearwards and downwards from a front portion of a bottom of the guiding portion 116. The flat surface 119 is formed on the bottom of the guiding portion 116 and adjoins a rear end of the bevel surface 117 of the guiding portion 116.

The connection portion 15 is formed on and protrudes rearwards from a rear portion of the base 11 and has a socket 150 formed in a rear of the connection portion 15. The two wing portions 13 are laterally formed on and protrude outwards from a periphery of the base 11. Each wing portion 13 has a fixing hole 131 and a positioning hole 133. The fixing hole 131 and the positioning hole 133 are formed through the wing portion 13.

Figure 4:
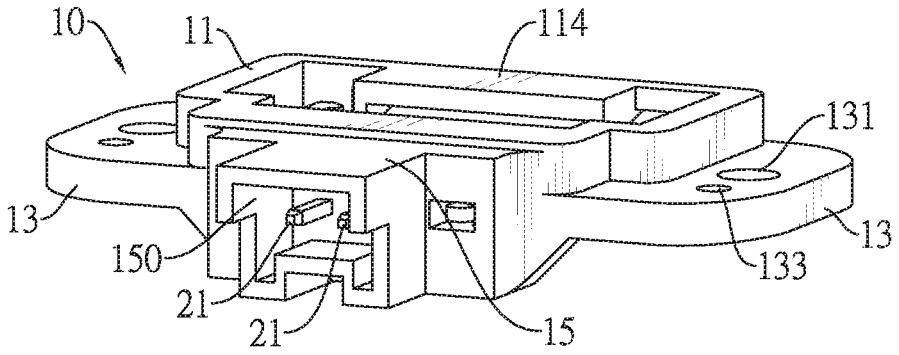
FIG. 4 is a third perspective view of the LED module holder in FIG. 1.
Figure 5:
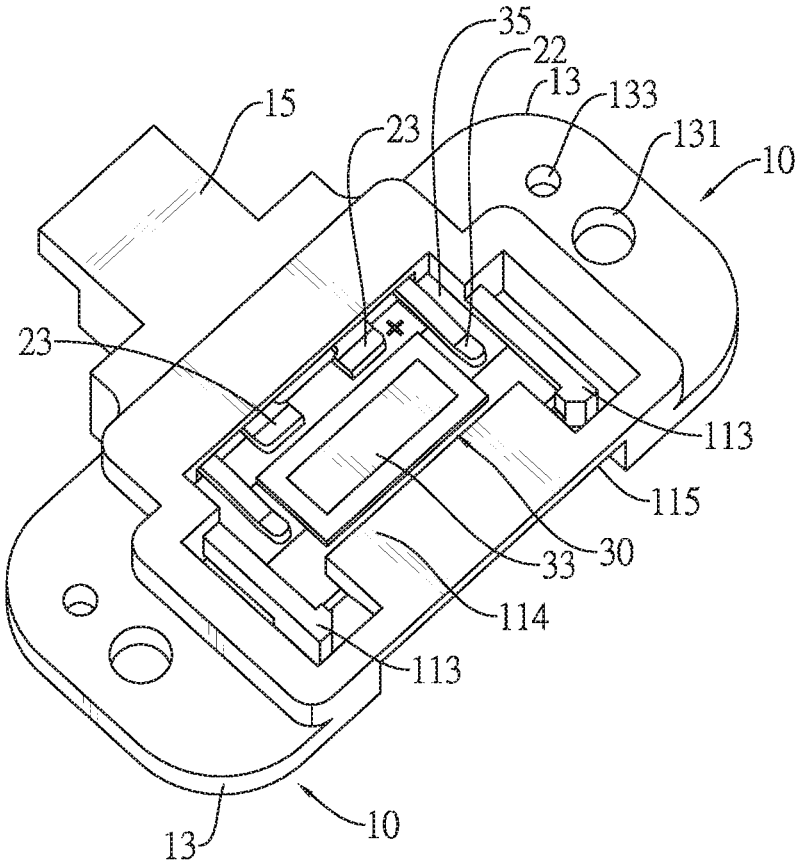
FIG. 5 is a fourth perspective view of the LED module holder in FIG. 1.

The two terminals 20 are securely mounted in the connection portion 15. Each terminal 20 has an insertion segment 21, an electrical contact segment 22 and a limiting piece 23. The insertion segment 21 is securely mounted inside the socket 150 of the connection portion 15 and extends rearwards as shown in FIG. 4. With reference to FIGS. 1 and 5, the electrical contact segment 22 is formed on a front end of the insertion segment 21 and extends forwards into the accommodation space 110 of the base 11. The limiting piece 23 is formed on the terminal 20 and is located above a corresponding rear rest 111.

Figure 6:
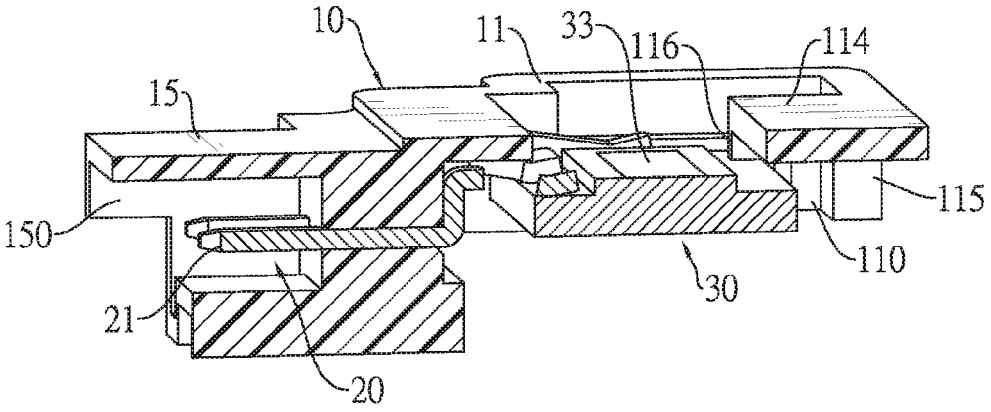
FIG. 6 is a cross-sectional perspective view of the LED module holder in FIG. 1.

With reference to FIGS. 2, 5 and 6, the LED module 30 is mounted into the accommodation space 110 of the base 11 through the front opening 115 of the base 11, and has a substrate 31, an LED die 33 and two electrodes 35.

The substrate 31 is mounted inside the accommodation space 10 and is held between the limiting pieces 23 of the terminals 20 and both of the rear rests 111 and the front rests 112. Besides, the substrate 31 is held by the two reverse-barb arms 113 to prevent the substrate 31 from escaping from the accommodation space 110 through the front opening 115. When entering the accommodation space 110 of the base 11 through the front opening 115, the substrate 31 is first guided by the two bevel surfaces 117 of the guiding portion 116. After the substrate 31 completely enters the accommodation space 110, the two flat surfaces 119 abut against the substrate 31 for the substrate 31 to be firmly positioned. The LED die 33 is mounted on the substrate 31. The two electrodes 35 are mounted on the substrate 31 to electrically contact the respective electrical contact segments 22 of the terminals 20.

Figure 7:
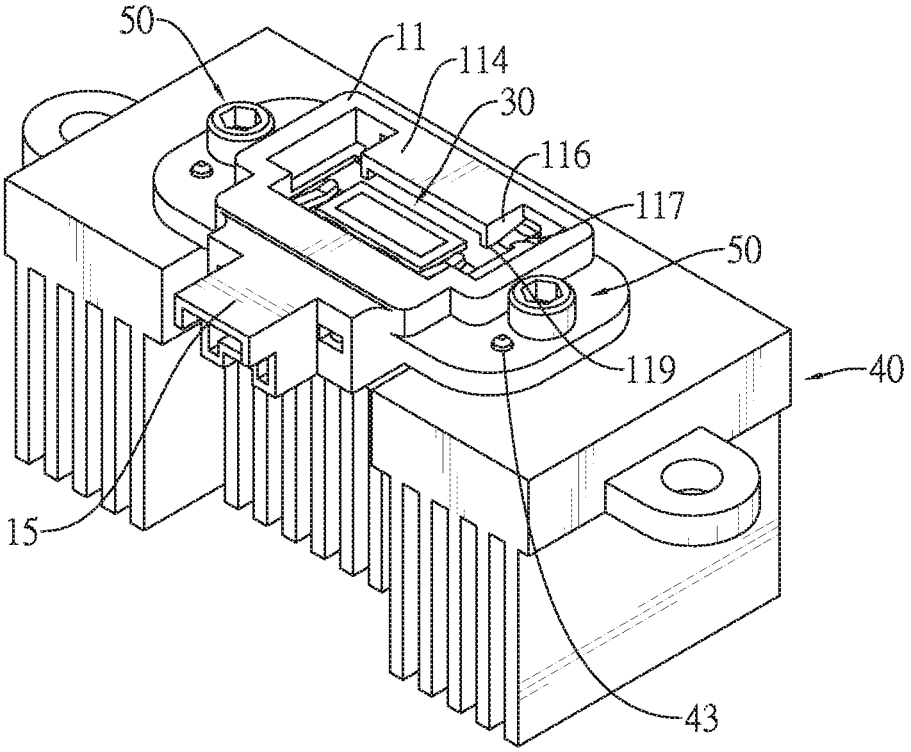
FIG. 7 is a perspective view of a second embodiment of an LED module holder in accordance with the present invention.
Figure 8:
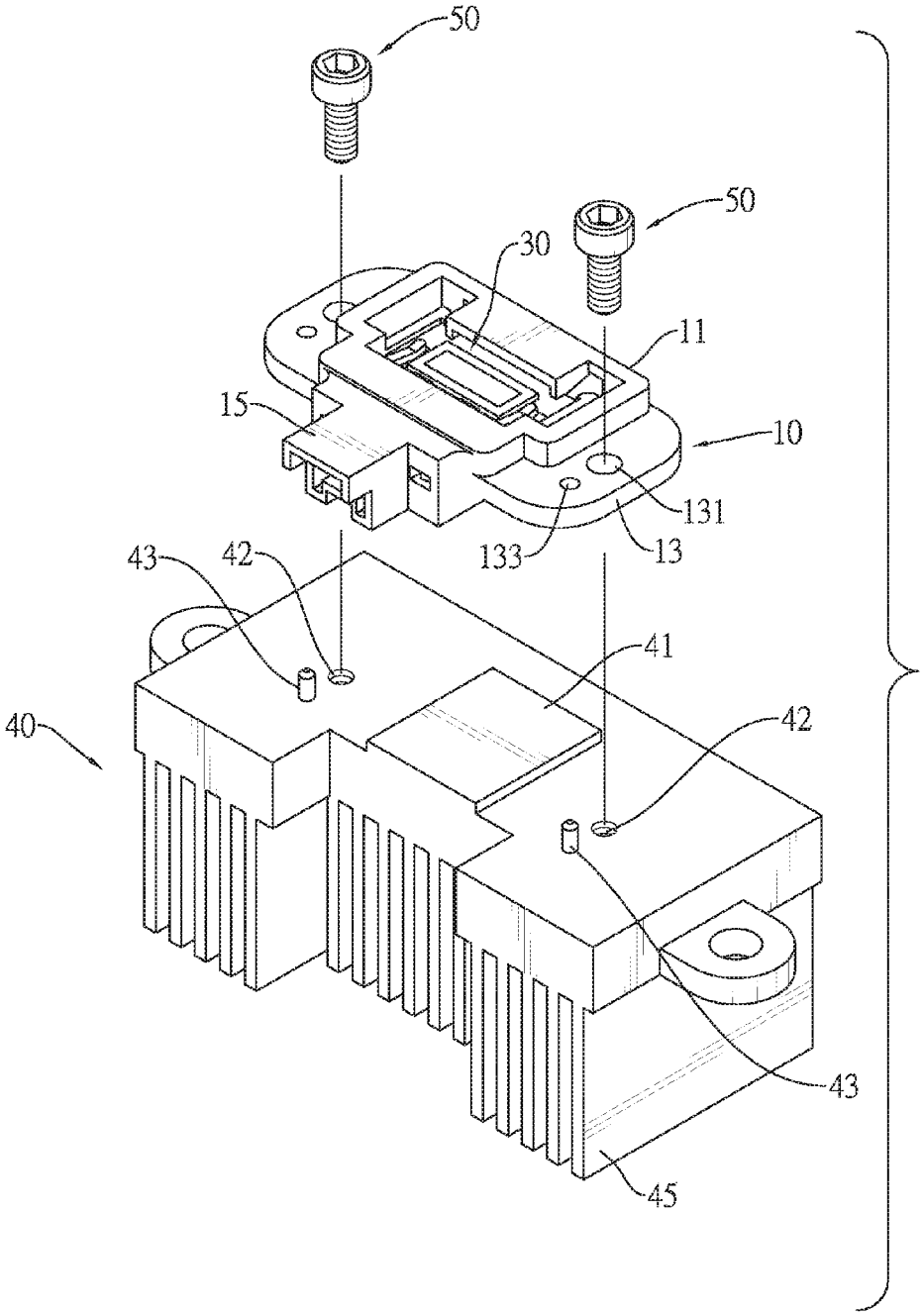
FIG. 8 is an exploded perspective view of the LED module holder in FIG. 7.
Figure 9:
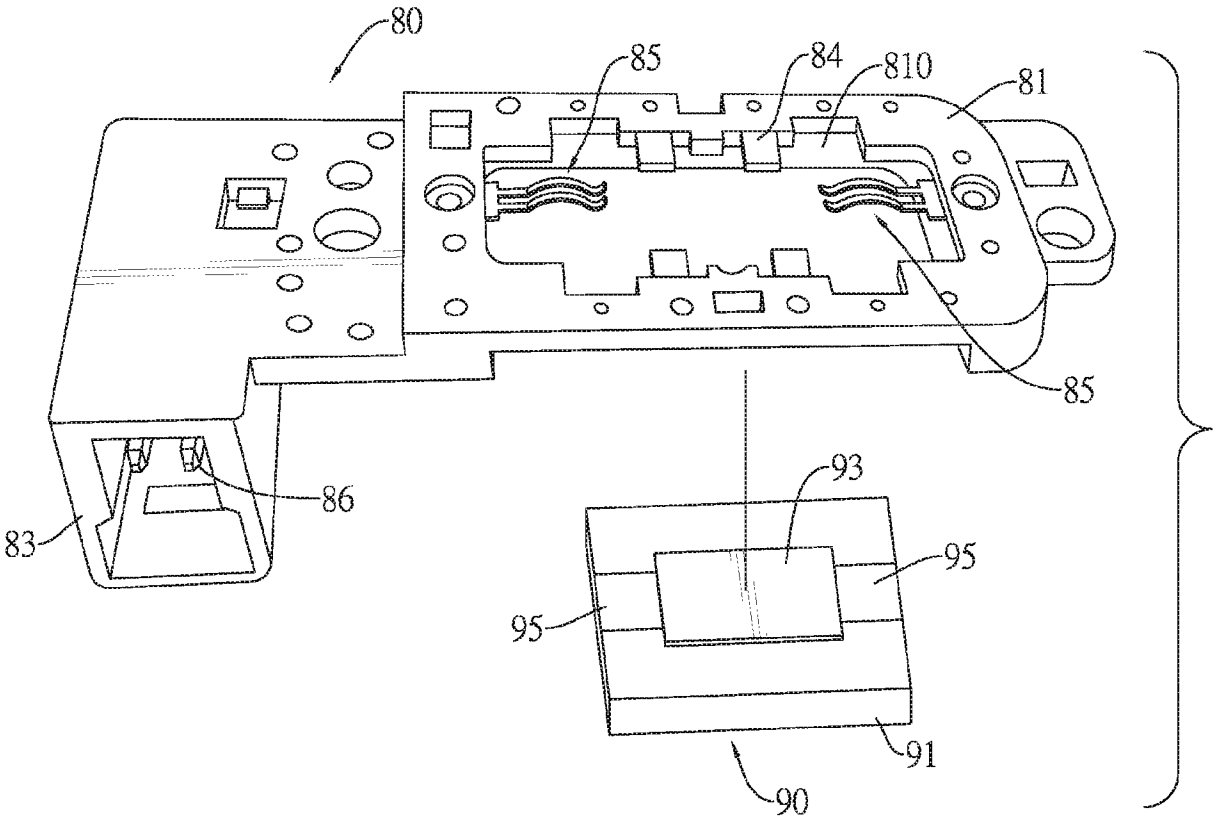
FIG.9 PRIOR ART
FIG. 9 is an exploded perspective view of a conventional fixing member for an LED module.

With reference to FIGS. 7 and 8, a second embodiment of an LED module holder in accordance with the present invention differs from the foregoing embodiment in an additional heat sink 40. The heat sink 40 has a heat-transfer plate 41, two coupling holes 42, two positioning pins 43 and multiple fins 45. The heat-transfer plate 41 is formed on a top of the heat sink 40 and enters the accommodation space 110 of the base 11 through a bottom opening of the base 11 that communicates with the accommodation space 110 to contact a bottom surface of the substrate 31. The two coupling holes 42 are formed in the top of the heat sink 40, correspond to the respective fixing holes 131 of the base 11, and may be internally threaded. The two positioning pins 43 are formed on the top of the heat sink 40 and are mounted through the respective positioning holes 133 of the base 11. The multiple fins 45 are formed on and protrude downwards from a bottom of the heat sink 40.

Two fasteners 50 are respectively and sequentially mounted through the fixing holes 131 of the base 11 and the coupling holes 42 of the heat sink 40, and may be bolts.

By virtue of the foregoing LED module holder, after entering the accommodation space 110 of the base 11, the substrate 31 is held between the limiting pieces 23 of the two terminals 20 and both the rear rests 111 and the front rests 112, such that the substrate 31 is unable to escape from the accommodation space 110 of the body 10 through a top opening or the bottom opening of the base 11. Accordingly, the LED module 30 can be securely and firmly mounted on the body 10. When the LED module holder is mounted to a lamp, all it needs is just to focus on the plug-in procedure of the connection portion 15 without worrying much about inadvertent falling off of the LED module 30. Additionally, the reverse-barb arms 113 further hold the LED module 30 to prevent the LED module 30 from escaping from the front opening 115 of the base 11.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A light-emitting diode (LED) module holder, comprising:

a body having:

a base having:

an accommodation space formed through the base;

a front opening formed through a front portion of the base;

two rear rests, each rear rest formed on and protruding inwards from a rear portion of one of two lateral inner walls of the accommodation space; and two reverse-barb arms respectively formed on and protruding inwards from the two lateral inner walls and located above the rear rests;

a connection portion formed on and protruding rearwards from a rear portion of the base and having a socket formed in a rear of the connection portion;

two terminals securely mounted in the connection portion, each terminal having:

an insertion segment securely mounted inside the socket of the connection portion and extending rearwards;

an electrical contact segment formed on a front end of the insertion segment and extending forwards into the accommodation space of the base; and a limiting piece formed on the terminal and located above a corresponding one of the rear rests; and an LED module mounted into the accommodation space of the base through the front opening of the base and having:

a substrate mounted inside the accommodation space, and held between the limiting pieces of the terminals and the rear rests and held by the two reverse-barb arms to prevent the substrate from escaping from the accommodation space through the front opening;

an LED die mounted on the substrate; and two electrodes mounted on the substrate to electrically contact the respective electrical contact segments of the terminals.

2. The LED module holder as claimed in claim 1, wherein the base further has two front rests and each front rest is formed on and protrudes inwards from a front portion of one of the two lateral inner walls of the accommodation space and is adjacent to the front opening for the substrate to be held between the limiting pieces of the terminals and the front rests.

3. The LED module holder as claimed in claim 1, wherein the body further has two wing portions laterally formed on and protruding outwards from a periphery of the base, and each wing portion has a fixing hole formed through the wing portion.

4. The LED module holder as claimed in claim 2, wherein the body further has two wing portions laterally formed on and protruding outwards from a periphery of the base, and each wing portion has a fixing hole formed through the wing portion.

5. The LED module holder as claimed in claim 3, wherein each wing portion further has a positioning hole formed through the wing portion.

6. The LED module holder as claimed in claim 4, wherein each wing portion further has a positioning hole formed through the wing portion.

7. The LED module holder as claimed in claim 5, wherein the base has a bottom opening communicating with the accommodation space, and the LED module holder further comprises:

a heat sink having:

a heat-transfer plate formed on a top of the heat sink and entering the accommodation space of the base through a bottom opening of the base to contact a bottom surface of the substrate;

two coupling holes formed in the top of the heat sink, and corresponding to the respective fixing holes of the base;

two positioning pins formed on the top of the heat sink and mounted through the respective positioning holes of the base; and multiple fins formed on and protruding downwards from a bottom of the heat sink; and two fasteners respectively and sequentially mounted through the fixing holes of the base and the coupling holes of the heat sink.

8. The LED module holder as claimed in claim 6, wherein the base has a bottom opening communicating with the accommodation space, and the LED module holder further comprises:

a heat sink having:

a heat-transfer plate formed on a top of the heat sink and entering the accommodation space of the base through a bottom opening of the base to contact a bottom surface of the substrate;

two coupling holes formed in the top of the heat sink, and corresponding to the respective fixing holes of the base;

two positioning pins formed on the top of the heat sink and mounted through the respective positioning holes of the base; and multiple fins formed on and protruding downwards from a bottom of the heat sink; and two fasteners respectively and sequentially mounted through the fixing holes of the base and the coupling holes of the heat sink.

9. The LED module holder as claimed in claim 1, wherein the base further has an extension formed on and protruding rearwards from an upper portion of a front inner wall of the accommodation space and having two guiding portions formed on a bottom of the extension, wherein each guiding portion has:

a bevel surface formed on and extending rearwards and downwards from a front portion of a bottom of the guiding portion; and a flat surface formed on the bottom of the guiding portion and adjoining a rear end of the bevel surface of the guiding portion;

wherein when entering the accommodation space of the base through the front opening, the substrate is first guided by the two bevel surfaces of the guiding portion, and after the substrate completely enters the accommodation space, the two flat surfaces abut against the substrate to position the substrate.

10. The LED module holder as claimed in claim 2, wherein the base further has an extension formed on and protruding rearwards from an upper portion of a front inner wall of the accommodation space and having two guiding portions formed on a bottom of the extension, wherein each guiding portion has:

a bevel surface formed on and extending rearwards and downwards from a front portion of a bottom of the guiding portion; and a flat surface formed on the bottom of the guiding portion and adjoining a rear end of the bevel surface of the guiding portion;

wherein when entering the accommodation space of the base through the front opening, the substrate is first guided by the two bevel surfaces of the guiding portion, and after the substrate completely enters the accommodation space, the two flat surfaces abut against the substrate to position the substrate.

11. The LED module holder as claimed in claim 7, wherein the base further has an extension formed on and protruding rearwards from an upper portion of a front inner wall of the accommodation space and having two guiding portions formed on a bottom of the extension, wherein each guiding portion has:

a bevel surface formed on and extending rearwards and downwards from a front portion of a bottom of the guiding portion; and a flat surface formed on the bottom of the guiding portion and adjoining a rear end of the bevel surface of the guiding portion;

wherein when entering the accommodation space of the base through the front opening, the substrate is first guided by the two bevel surfaces of the guiding portion, and after the substrate completely enters the accommodation space, the two flat surfaces abut against the substrate to position the substrate.

12. The LED module holder as claimed in claim 8, wherein the base further has an extension formed on and protruding rearwards from an upper portion of a front inner wall of the accommodation space and having two guiding portions formed on a bottom of the extension, wherein each guiding portion has:

a bevel surface formed on and extending rearwards and downwards from a front portion of a bottom of the guiding portion; and a flat surface formed on the bottom of the guiding portion and adjoining a rear end of the bevel surface of the guiding portion;

wherein when entering the accommodation space of the base through the front opening, the substrate is first guided by the two bevel surfaces of the guiding portion, and after the substrate completely enters the accommodation space, the two flat surfaces abut against the substrate to position the substrate.

13. The LED module holder as claimed in claim 11, wherein the two coupling holes of the heat sink are internally threaded, and the two fasteners are bolts.

14. The LED module holder as claimed in claim 12, wherein the two coupling holes of the heat sink are internally threaded, and the two fasteners are bolts.

* * * * *